United States Patent [19]

Schumer

[11] Patent Number: 4,926,968

[45] Date of Patent: May 22, 1990

[54] LADDER SUPPORTS

[76] Inventor: Leroy F. Schumer, Rte. 1, #1627, Perryville, Mo. 63775

[21] Appl. No.: 409,070

[22] Filed: Sep. 19, 1989

[51] Int. Cl.[5] ..... E06C 5/36

[52] U.S. Cl. ..... 182/172; 182/107

[58] Field of Search ..... 182/172, 165, 177, 91, 182/107; 248/351

[56] References Cited

U.S. PATENT DOCUMENTS 636,444 11/1899 Murray ..... 182/172

2,997,127 8/1961 Wojtowicz ..... 182/172

3,139,155 6/1964 Skeels ..... 182/106

FOREIGN PATENT DOCUMENTS 1467900 12/1966 France ..... 182/172

*Primary Examiner*—Reinaldo P. Machado

*Attorney, Agent, or Firm*—H. Jay Spiegel

[57] ABSTRACT

A sway brace is attached to each of the opposite sides of a step ladder. The attachment is made by a bolt passing through aligned holes in the brace leg and an associated ladder leg. The bolt hole in the brace leg is oversized to permit it to swing to a bracing position. A compression spring takes up the resulting looseness.

8 Claims, 2 Drawing Sheets

LADDER SUPPORTS

BACKGROUND OF THE INVENTION

This application is related to application Ser. No. 06/822,013, filed Jan. 24, 1986, now abandoned.

This invention relates to ladder supports and, more particularly—although not exclusively—to sway bracing supports for step ladders.

The following references were cited during the prosecution of prior application Ser. No. 06/822,013: U.S. Pat. Nos. 636,444 to Murray, 2,997,127 to Wojtowicz and 3,139,155 to Skeels; French Patent No. 1,467,900 to Rivoal. The present invention as claimed herein is believed to patentably distinguish from the teachings of these references.

Since ladders may slip and fall, it is common practice for employers to assign two persons to jobs involving ladders. One person climbs the ladder, while the second person merely stands there and holds the ladder to keep it from slipping. From a practical economic viewpoint, the second person is doing nothing, even though he is required to be present for purely safety reasons.

If the ladder is used by a person who is alone, there is no one to hold the ladder. Therefore, the user accepts the risk that the ladder may slip. This means that he is exposing himself to a fall, which could lead to a serious injury.

These and similar problems relating to a slipping ladder exist for all forms of ladders. As the ladder becomes taller, an extension ladder, for example, the consequences of a fall become more serious.

SUMMARY OF THE INVENTION

Accordingly, an object of the invention is to provide new and improved means for supporting ladders and for providing sway bracing therefor. Here, an object is to provide such sway bracing which prevents sideward movement of ladders. In this connection, an object is to keep ladders from walking, while in use.

Another object of the invention is to provide ladders having sway bracing which may, nevertheless, be stored in substantially the same amount of space that conventional ladders may be stored in, but which may be spread to provide a sway bracing, support base, when the ladder is in use.

In keeping with an aspect of this invention, these and other objects of the invention are accomplished by providing a bracing leg which is approximately one-half to three-quarters of the length of most ladders. The top of the bracing is attached to the ladder with a hinged-joint so that it may lie flat against the leg of the ladder, for storage, or may swing out to a fixed bracing position when the ladder is in use. A spring takes up play in the hinged-joint and normally tends to urge the bracing leg toward a closed position when the ladder is not in use. A chain limits the outward movement of the bracing leg at the extremity of its movement to the bracing position.

BRIEF DESCRIPTION OF THE DRAWINGS

A preferred embodiment of the invention is shown in the attached drawings, in which:

While the invention may find use in connection with any of many different forms of ladders, FIGS. 1 and 2 show a step ladder, by way of example. Also, these figures show ladders of medium length; however, the invention may be applied to ladders of any suitable length. Therefore, this election to show and refer to a step ladder is to be construed to refer to any suitable ladder of any suitable length.

Figure 1:
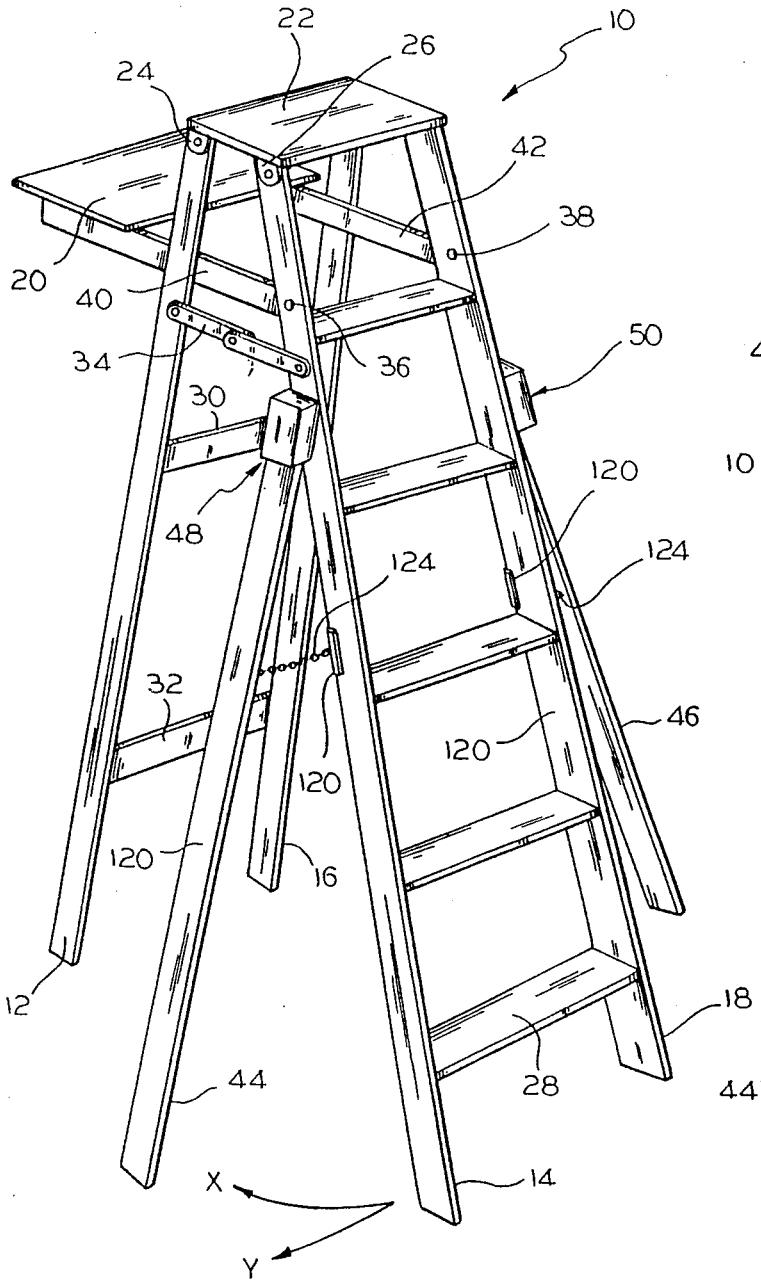
FIG. 1 is a perspective view which shows a step ladder with a pair of bracing legs in a deployed position.

In greater detail, a step ladder 10 is of any conventional design and is made of any conventional material. It is here assumed to be a wooden step ladder having six steps. The ladder is depicted as having four legs 12, 14, 16, 18 and the usual folding shelf 20. The top step 22 has four dependent tabs, such as 24, 26 to which the step ladder legs are pivotally attached. The steps, such as 28, are secured between the front or weight support legs 14, 18. These steps and any suitable cross bracing 30, 32 give lateral stability to the four legs, 12, 14, 16, 18. A folding brace member 34 is pivotally attached to fold or to extend between the front and back legs 12, 14, and 16, 18 to keep the step ladder secure when it is deployed into a load bearing position. The shelf 20 is pivotally connected at 36, 38 to the front and weight bearing legs 14, 18 to swing up to a stored position or to swing down to an operating position. In the operating position, the shelf support arms 40, 42 also add stability which helps maintain the deployed leg position.

Figure 3:
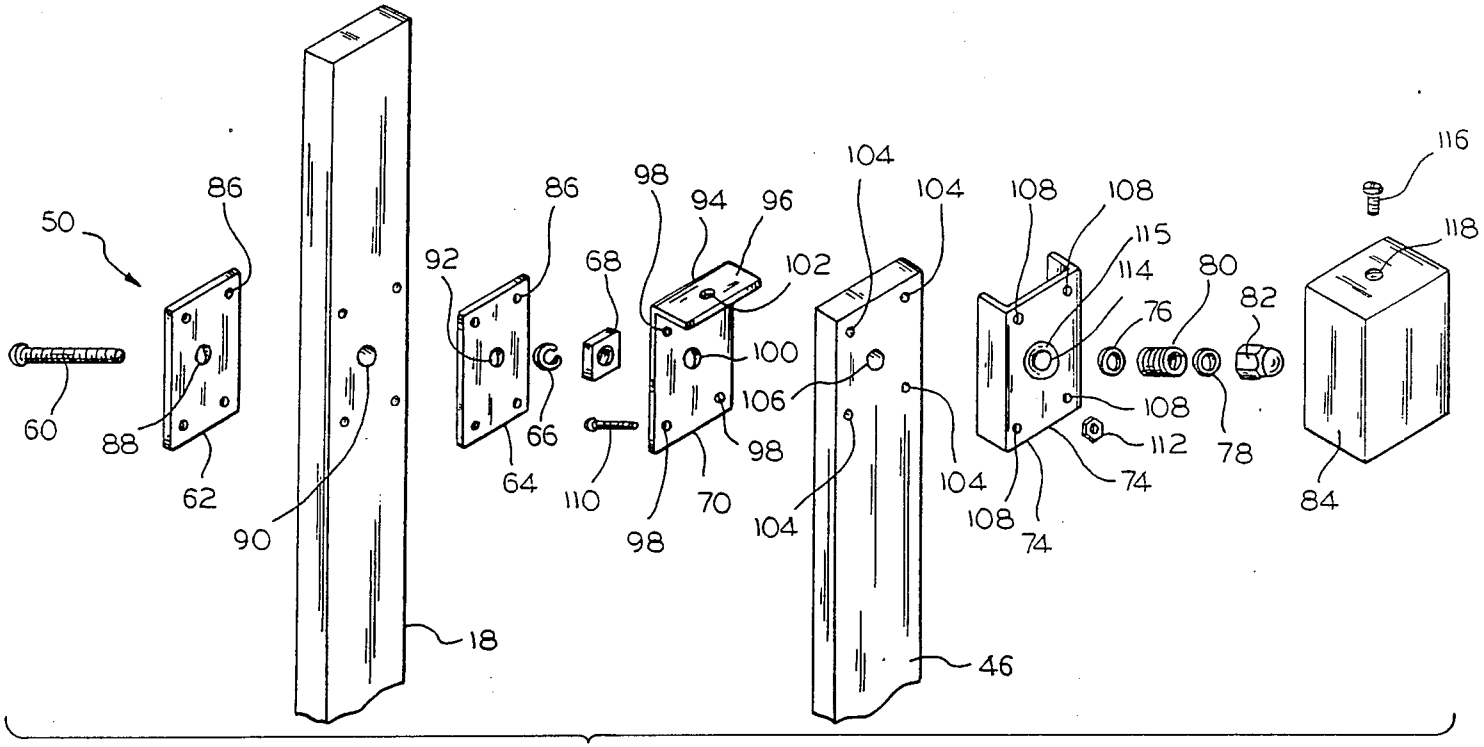
FIG. 3 is an exploded view showing the hinged-joint member which is adapted to swingingly secure the bracing leg to the step ladder of FIGS. 1 and 2.

A pair of bracing legs 44, 46 are pivotally attached at 48, 50, respectively, to each of the weight bearing legs 14, 18 at an appropriate location above the floor and along the length of the weight bearing legs. At the pivot points 48, 50 is a hinge mechanism which is shown in greater detail in FIG. 3 and includes a fragment of the step ladder leg 18, by way of example. The brace legs may be spread as shown in FIG. 1 to provide sway bracing. In side elevation, the brace legs are generally vertical while, in front elevation, they are spread, when the ladder is in its operating position.

The principle components of the hinge mechanism (FIG. 3) include rod means in the form of a threaded carriage bolt 60, a pair of steel plates 70, a brace leg 46, a brace support plate 74, a pair of flat washers 76, 78, a compression spring 80, an acorn nut 82, and a cover plate 84. The brace leg 46, and its plates 70, 74 have slightly oversized center holes for receiving the carriage bolt 60, which provide enough play to enable the brace leg to move between the stored and deployed positions.

In the following parts of the specification, it will be convenient to refer to specific dimensions. However, it should be understood that these dimensions are exemplary, and that parts of any reasonable dimensions may be provided.

The carriage bolt 60 is threaded and may be approximately three inches long. Each of the steel plates 62, 64 may be approximately $1/16 \times 2 \times 3\frac{1}{2}$ inches, with four $\frac{1}{8}$-inch holes 86 set in from the edges approximately $\frac{1}{2}$-inch, at each corner of the plates. Wood screws, not shown, pass through holes 86 to secure 62, 64 to the opposite sides of the step ladder leg 18. Each of the center holes 88, 90, 92 in the steel plates and the leg 18 has a diameter of approximately $\frac{3}{8}$-inch, to fairly snugly receive the bolt 60. The carriage bolt 60 passes from inside the leg 18, through center holes 88, 90, 92, receives lock washer 66, and is firmly secured in place on leg 18, by nut 68.

The brace plate 70 is made from a steel plate which originally is approximately $4\frac{1}{2} \times 2\frac{1}{2} \times 1/16$-inches and which is folded at 94 to provide a one-inch top flange. Each corner of the larger side of brace plate 70 has hole 98 formed therein, $\frac{3}{8}$-inch from the edges of the plate. The center hole 100 is approximately 7/16-inch in diameter, which is slightly larger than the diameter of the carriage bolt 60 and, therefore, allows some play. The top flange 96 of the brace plate includes a hole 102 which is drilled and tapped to receive a screw 116 which passes through a hole 118 in the top of the cover plate 84.

The brace leg 46 has four holes 104 drilled therein at locations corresponding to the four holes 98 in the brace plate 70. The center hole 106 in brace leg 46 is the same diameter as center hole 100 in plate 70. The brace leg may have any suitable length, such as:

| LADDER SIZE | BRACE LEG LENGTH |
|---|---|
| Under 5 Feet | The brace leg may be cut to a proper length |
| 5-Feet | 4 Feet |
| 6-Feet | 5 Feet |
| 7-Feet | 6 Feet |
| 8-Feet | 7 Feet |
| 9-Feet and Over | 8 Feet |

The brace support plate 74 has four corner holes 108 which are positioned to match the holes 98 in brace plate 96 and holes 104 in the brace leg 46. Therefore, the brace plate 96, brace leg 46, and brace support plate 74 may be bolted together. By way of example, bolt 110 is shown as being positioned to pass through the lower left-hand (as viewed in FIG. 3) holes 70, 108 and to be secured in place by a nut 112.

The center holes 114, 106, 100 have the same diameter. In addition, hole 114 has a surrounding, generally dish or bowl shaped, recess 115 which receives the washer 76. A compression spring 80 is clamped between the washers 76 and 78, and exerts enough pressure to enable the washer to move and to seat itself firmly in the dish shaped recess 115 surrounding the hole 114.

The assembly is complete when the acorn nut 82 is tightened onto the carriage bolt 60 with sufficient force to compress the spring 80.

Finally, the cover plate 84 is placed over the assembly and screw 116 is fitted through the hole 118 and turned into the threaded hole 102.

To install the inventive leg brace on an existing step ladder, it is spread and set in an upright position, with legs 12, 14, 16, 18 resting firmly on a level floor. The brace legs are spread to the deployed position and their lower ends are horizontally aligned, evenly with the bottoms of the other ladder legs. A pencil is placed in the center of the hole 106 in the brace legs 44, 46, and a mark is made on the weight bearing ladder legs 14, 18. A $\frac{3}{8}$-inch drill bit is used to drill respective holes through steel plate 62. Another steel plate 64 is placed over bolt 60 and nut 68 is tightened. Then, eight screws (not shown) are installed in holes 86, after which lock washer 66 and nut 68 are securely tightened. With the brace plate 70 flange 96 in place over the top of the leg 46, and with brace support plate 74 in place on the other side of brace leg 46, bolts 110 are run through aligned holes 98, 104, 108, after which lock washers and nuts 112 are installed. With the brace support plate 74 facing outwardly, the brace leg is installed over the bolt 60, which passes through holes 100, 106, 114. Then, washer 76 is placed over bolt 60 and into the dome shaped recess 115 surrounding hole 114. Compression spring 80, washer 78, and acorn nut 82 are placed over the end of the bolt 60. Then, the cover plate 84 is installed.

After the brace leg is so installed over bolt 60, a mark is made at 120 (FIG. 1) on ladder legs 14, 18 and on the brace legs 44, 46 approximately twelve to sixteen inches below bolt 60. A carriage bracket (FIG. 4) is installed on each of the four legs. Holes are drilled and each of these brackets is fastened with screws.

Figure 4:
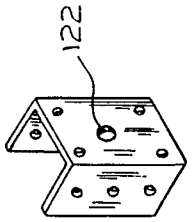
FIG. 4 is a perspective view of a carriage plate for securing a holding chain to a leg of the ladder.

A bolt is passed through the step ladder leg and the plate of FIG. 4 to secure an end of a chain 124 (FIG. 1, 2) to the step ladder. Then, with the brace legs 44, 46 spread to their operating position, a number of links are counted while chains 124 are stretched between the legs 14, 44 and 18, 46, respectively to find how long the chain should be. A hook is placed in the brace leg opposite the carriage plate of FIG. 4. The link at the end of chain 124 is placed over the hook, which is then closed to capture it.

Figure 2:
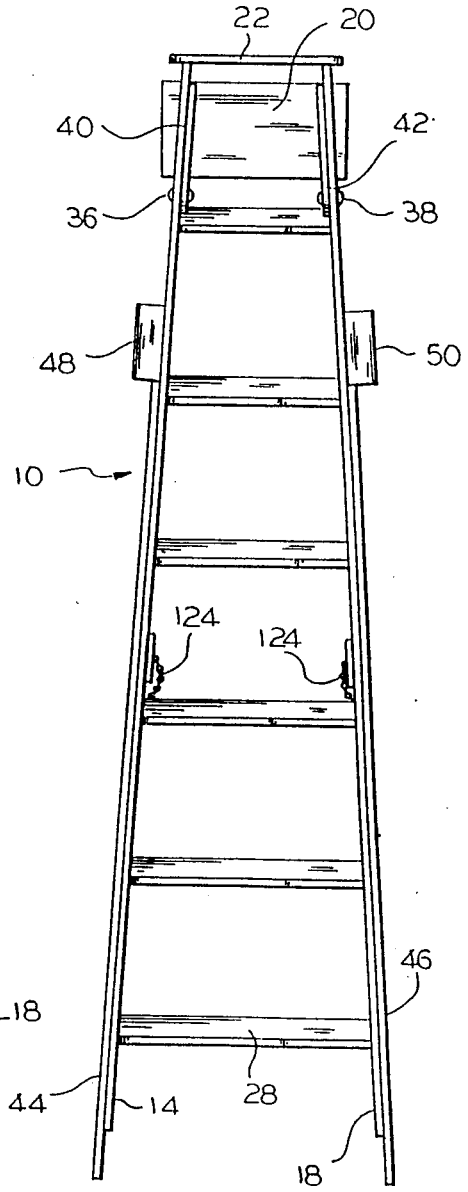
FIG. 2 is a front elevation view which shows a step ladder with the bracing legs in a stored position.

To spread and use the ladder, the brace leg 44 is swung in direction X (FIG. 1) on a hinge pin formed by bolt 60 and in direction Y, as a result of the play provided by the slightly oversized center holes 100, 106, 114, with an accompanying tightness provided by the compression of spring 80. The brace legs 44, 46 are spread sufficiently to tighten the chains 124. For storage, (FIG. 2), the brace legs are swung back in directions opposite X and Y. Then, the step ladder is closed in a conventional manner.

Those who are skilled in the art will readily perceive how to modify the invention. Therefore, the appended claims are to be construed to cover all equivalent structures which fall within the true scope and spirit of the invention.

I claim:

1. A ladder comprising at least first and second legs with a plurality of steps or rungs therebetween for bearing the weight of a person standing thereon, a brace leg pivotally attached to each of said weight bearing legs, means for providing said pivotal attachment by enabling said brace leg to swing into a spread and generally vertical position when said ladder is in a weight supporting position, said spread position being with said brace swung horizontally outward from the weight bearing leg of said ladder to provide sway bracing for said ladder, means for limiting said outward movement of said brace leg away from said weight bearing legs, and compression spring means associated with said pivotal attachment and positioned on a side of said brace leg remote from said weight bearing leg, said horizontal swinging of said leg compressing and being opposed by said spring.

2. The ladder of claim 1 wherein said pivotal attachment means comprises a rod means having a diameter and passing through aligned holes in said weight bearing leg and said bracing leg to facilitate a swinging of said brace leg on said rod means to said spread and generally vertical position, the hole in said brace leg being sufficiently oversized relative to the diameter of said rod means to enable said brace leg to move horizontally away from said weight bearing legs far enough to provide sway bracing for said ladder.

3. The ladder of claim 2 said compression spring being associated with said rod means for normally pressing said bracing leg into a generally tight position against the weight bearing leg of said ladder despite the looseness provided by said oversized holes.

4. The ladder of claim 3 wherein said weight bearing legs and said bracing legs are wooden and metal plates cover said wood in the areas of holes through which said rod means passes.

5. The ladder of claim 4 wherein said rod means is a bolt and said metal plates are positioned over and form at least part of said holes through which said bolt means passes.

6. The ladder of claim 5 wherein holes in said metal plates and said brace leg are positioned over a free end of said bolt secured to and projecting beyond said weight bearing leg.

7. A ladder comprising at least first and second legs with a plurality of steps or rungs therebetween for bearing the weight of a person standing thereon, a brace leg pivotally attached to each of said weight bearing legs, means for providing said pivotal attachment by enabling said brace leg to swing into a spread and generally vertical position when said ladder is in a weight supporting position, said spread position being with said brace swung horizontally outward from the weight bearing leg of said ladder to provide sway bracing for said ladder, means for limiting said outward movement of said brace leg away from said weight bearing legs, said pivotal attachment means comprising a rod means in the form of a bolt having a diameter and passing through aligned holes in said weight bearing leg and said bracing leg to facilitate a swinging of said brace leg on said rod means to said spread and generally vertical position, the hole in said brace leg being sufficiently oversized relative to the diameter of said rod means to enable said brace leg to move horizontally away from said weight bearing legs far enough to provide sway bracing for said ladder, a compression spring associated with said rod means for normally pressing said bracing leg into a generally tight position against the weight bearing leg of said ladder despite the looseness provided by said oversized holes, said horizontal swinging of said leg compressing and being opposed by said spring, said compression spring fitting(s) over said free end of said bolt and resting against a plate on said brace leg, a nut on the free end of said bolt pressing said spring against said plate to place it in compression, said weight bearing legs and said bracing legs being wooden with metal plates covering said wood in areas of holes through which said rod means passes, said metal plates being positioned over and forming at least part of said holes through which said rod means passes, said metal plates and said brace leg being positioned over a free end of said rod means secured to and projecting beyond said weight bearing leg.

8. The ladder of claim 7 and a cover plate covering said bolt and components mounted thereon, said cover plate resting against said weight bearing leg.

* * * * *